United States Patent [19]

Spivey

[11] 4,162,607

[45] Jul. 31, 1979

[54] ENTANGLED YARNS

[75] Inventor: Bron W. Spivey, Asheville, N.C.

[73] Assignee: Akzona Incorporated, Asheville, N.C.

[21] Appl. No.: 812,436

[22] Filed: Jul. 1, 1977

[51] Int. Cl.[2] ..... D02J 1/22; D02G 1/00

[52] U.S. Cl. ..... 57/287; 57/310

[58] Field of Search ..... 57/34 R, 34 HS, 36, 57/51-51.6, 55.5, 156, 157 R, 157 S, 157 TS, 157 MS, 160

[56] References Cited

U.S. PATENT DOCUMENTS

| | | | |
|---|---|---|---|
| 2,407,358 | 9/1946 | Whisnant | 57/157 S |
| 2,810,949 | 10/1957 | Silver | 57/157 R |
| 3,016,677 | 1/1962 | Langway | 57/34 R |
| 3,289,400 | 12/1966 | Scragg | 57/157 TS |
| 3,306,023 | 2/1967 | Henshaw et al. | 57/157 R |
| 3,309,855 | 3/1967 | Stoll et al. | 57/34 B |
| 3,438,193 | 4/1969 | Kosaka et al. | 57/144 |
| 3,468,120 | 9/1969 | Hildebrand | 57/34 R X |
| 3,498,043 | 3/1970 | Moffett et al. | 28/247 X |
| 3,686,846 | 8/1972 | Smith | 57/157 TS X |
| 3,831,231 | 8/1974 | Binford et al. | 28/258 X |
| 3,831,365 | 8/1974 | Smith | 57/157 TS X |
| 4,016,715 | 4/1977 | London | 57/157 TS |
| 4,074,511 | 2/1978 | Chambly et al. | 57/106 X |

*Primary Examiner*—Donald Watkins
*Attorney, Agent, or Firm*—Craig and Antonelli

[57] ABSTRACT

In order to interlace a plurality of textured filaments and produce bundled yarn, a plurality of textured filaments having reverse twists creating opposing torques, of which the bundled yarn is to be formed, are initially subjected to a prescribed degree of tension. The tensioned filaments are then brought together and permitted to relax. Upon relaxing, the textured filaments tend to entangle with each other to form the bundled yarn having a resultant neutral torque. The entanglement is carried out without the need for supplying jets of air to the yarn to force them to tangle together.

13 Claims, 2 Drawing Figures

ENTANGLED YARNS

FIELD OF THE INVENTION

The present invention relates to a process and apparatus for forming bundled yarn from false twisted textured filaments.

DESCRIPTION OF THE PRIOR ART

A number of techniques for obtaining bundled filament yarn by a process of directing jets of air upon the filaments have been proposed. For example, the U.S. patents to Breen et al. U.S. Pat. No. 3,116,588 and Bunting et al. U.S. Pat. No. 2,990,671 describe a process for bundling yarn wherein a twisting fluid, such as an inert gas, is directed at the yarn as it is fed through the yarn handling system. The jet of fluid which strikes the yarn momentarily separates the filaments, thereby subjecting the individual filaments to the twisting action of the jet, resulting in the filaments twisting upon themselves and about adjacent filaments and groups of filaments. The particular devices employed in the patented apparatus are referred to as vortex twisters.

In a similar fashion, British Pat. No. 1,029,097 and U.S. Pat. No. 3,273,328 describe techniques for interlacing plural textile filaments by directing high volicity air against the filaments to cause the filaments to interlace.

The yarns resulting from the action of the high velocity fluid in the systems described in the above-referred to patents are commonly called "air-tangled yarns". The equipment required to produce the air entanglement is both complex and costly, particularly where it is to be incorporated into on-line texturing machines.

Bundling of multifilament yarn may also be accomplished by feeding plural filaments through false-twist devices, and then selectively tensioning, heating, and relaxing the false twisted yarn as described in U.S. Pat. Nos. 3,691,750 and 3,540,204. The tensioning of the yarns is effected by passing the false-twisted filaments over draw rolls at a high speed. The tensioned yarns are then heated and drawn over draw rolls rotating at a relatively lower speed so that the tensioned filaments are caused to relax.

SUMMARY OF THE INVENTION

In accordance with the present invention, applicant has developed a technique of entangling textured yarns without having to employ the air-tangling devices of the type described above and also improves upon the systems described in U.S. Pat. Nos. 3,691,750 and 3,540,204. In accordance with the present invention, a very simple and inexpensive technique of bundling or interlacing together textured yarns can be carried out by the sequential steps of tensioning and relaxing plural textured yarn filaments having reversely imparted torque.

More specifically, in accordance with the present invention, plural textured filaments, such as filaments which have been imparted with opposing torques such as through "s" and "z" twists by appropriate false twisting equipment, are initially subjected to a prescribed degree of tension as they move through a yarn handling machine. This is preferably effected by underfeeding the yarn through one of the yarn feeds in an auxiliary zone of the machine. The tensioned and oppositely twisted filaments are then brought together and permitted to relax, preferably by overfeeding the filaments as they are taken up on a take-up package, whereby those filaments having "s" twist tend to entangle with those filaments have "z" twist and form a bulk structure which has a resultant neutral torque.

The present invention is readily adaptable to existing yarn handling production equipment and does not involve complex alterations of such equipment as in the case of the prior art where fluid jet apparatus were used.

DETAILED DESCRIPTION OF THE INVENTION

Figure 1:
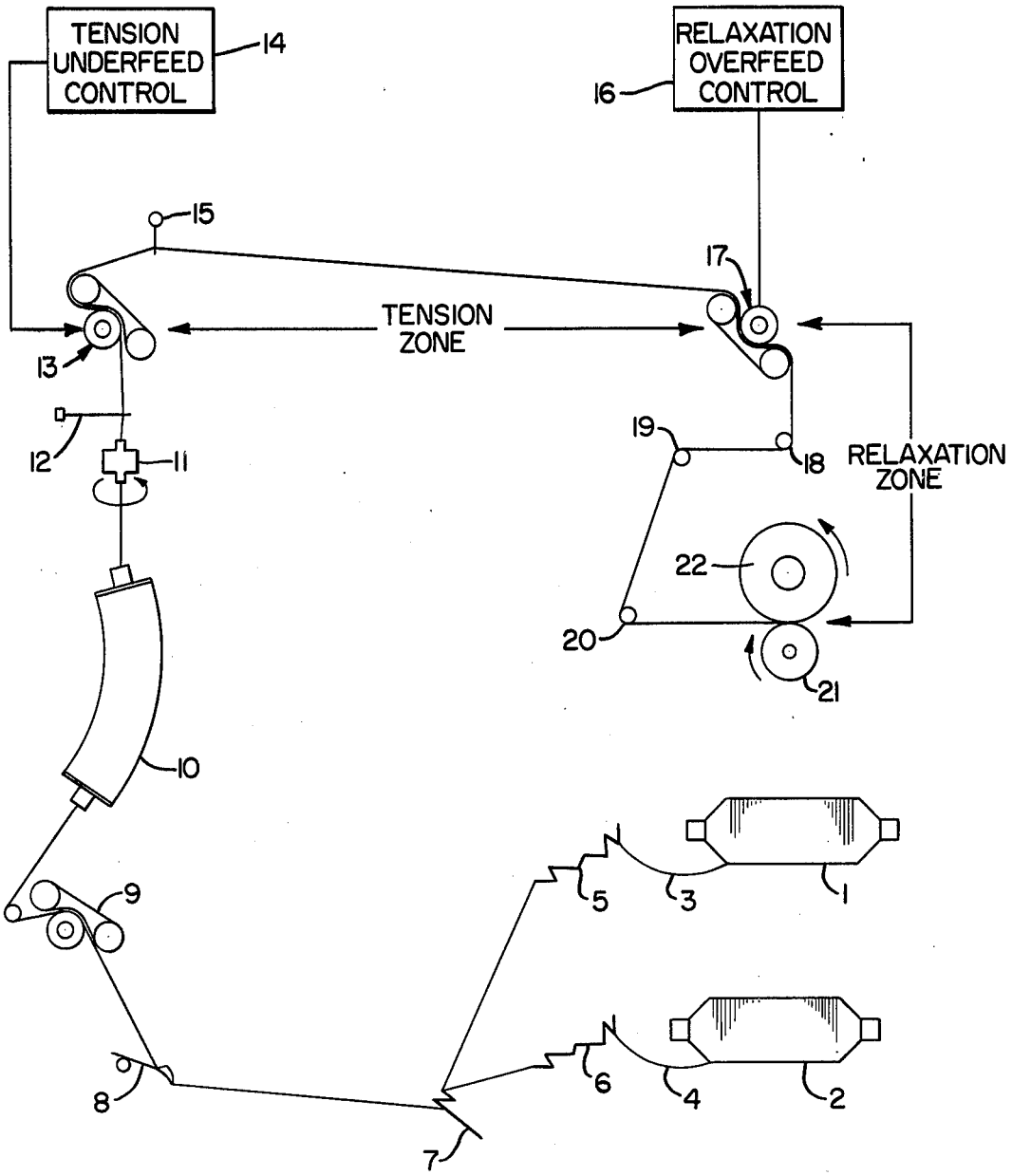
FIG. 1 is a schematic illustration of a false-twisting texturing textile apparatus incorporating the yarn bundling technique of the present invention.

Referring to FIG. 1, there is schematically illustrated a commercial ARCT FT-415 false-twisting texturing machine through which a plurality of filaments continuously move and into which the present invention has been incorporated. The yarn filaments are taken from a plurality of supply creels 1 and 2 (while only two creels are shown, it is to be understood that more than two creels of filaments may be provided) and drawn through guide and tension discs 5 and 6, respectively. After passing over guide members 7 and 7, separate filaments are drawn through a first yarn feed 9 and pass through a tube-type conduction heater 10. Upon emergizing from the tube-type conduction heater 10, the yarns pass through a flase-twist spindle device 11, so that upon emerging from the device 11, respective filaments are textured with "s" and "z" twists. Upon passing through the guide 12 at the output of the spindle device 11, the yarns are fed through a second yarn feed 13, and, by way of guide 15, are supplied to the third yarn feed 17. During the movement of the yarn between yarn feed 13 and yarn feed 17, tension is imparted to the filaments by way of tension underfeed control 14 which causes the yarn feed 13 to underfeed the filaments as they move toward yarn feed 17.

The individual reversely-torqued filaments are brought together and subjected to an overfeed at yarn feed 17 under control of relaxation overfeed control 16. As the individual reversely twisted or torqued filaments emerge from yarn feed 17 in a relaxed state, they tend to entangle with one another to form a bulk which has an effective neutral torque due to the counteracting effect of the opposing torques of the entangled filaments. This bulk is taken up by takeup package 22 as the yarn passes over roller guides 18 through 21.

During the texturing of the yarn, since the individual respective filaments are imparted with "s" and "z" twists, when the filaments are brought together and are caused to relax at the third yarn feed 17, the opposed torque in the textured filaments aids in causing the entanglement of the yarns to form the bulk material of neutral torque.

Figure 2:
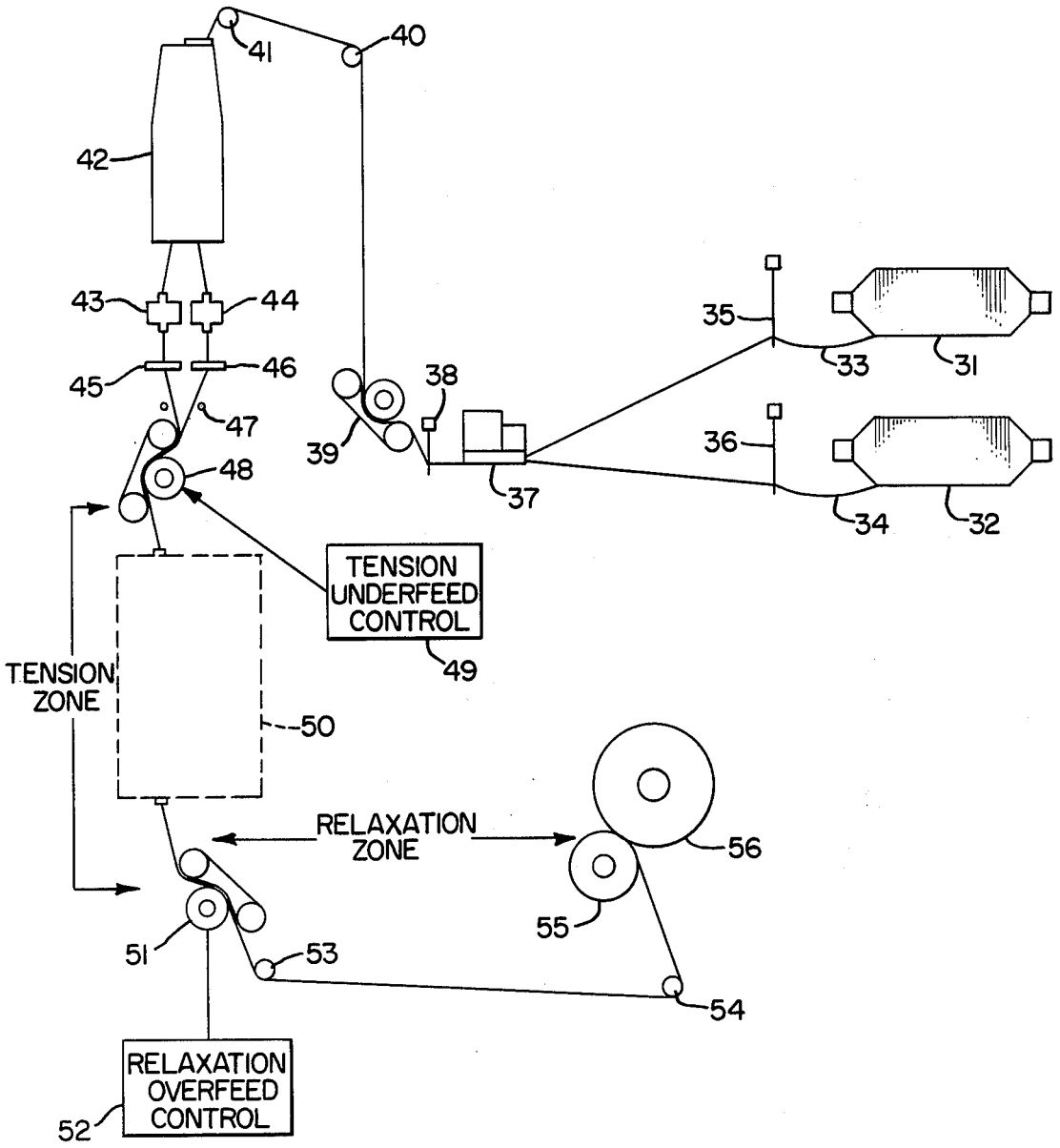
FIG. 2 is a schematic illustration of another yarn handling textile apparatus wherein the present invention may be readily incorporated.

The present invention may also be incorporated in an apparatus of the type illustrated in FIG. 2.

The apparatus in FIG. 2 corresponds to a Barmage FK5 CS Machine equipped with Barmag Dowtherm Heaters, into which the present invention has been incorporated.

From a plurality of supply packages 31 and 32, filaments 33 and 34 pass through guides 35 and 36, respectively, and are subjected to an initial tension by yarn tensioner 37. The filaments then pass through a thread-guide fork 38, through an input feed 39, and then over guide rollers 40 and 41 to a first stage conduction heater 42.

Upon emerging from the first stage conduction heater 42, separated filaments are textured with opposing torque by a twin-unit spindle, including spindles 43 and 44. The yarn is then drawn past yarn break sensors 45 and 46 and guided through a thread-guide fork 47 to an intermediate feed 48. As the yarn passes through a second stage convection heater 50, which is turned off during the tensioning process, the tension underfeed control 49 causes the intermediate feed 48 to underfeed the yarn and thereby subject the textured filaments to a prescribed degree of tension. Upon emerging from the second stage convection heater the yarn passes over an output yarn feed 51 which overfeeds the yarn as it passes over guide rollers 53 through 55 to a takeup package 56. As the yarn enters the relaxation zone, the oppositely torqued filaments tangle together to form a bulk. The degree of overfeed is controlled by relaxation overfeed control 52, in the same fashion that relaxation overfeed control 16 in the embodiment shown in FIG. 1 controls the degree of overfeed of yarn feed 17.

As was the case with the embodiment shown in FIG. 1, the opposing torque may be developed by imparting appropriate "s" and "z" twists by the spindle units 43 and 44 to help the textured filaments entangle themselves together.

As was pointed out previously, a significant advantage of the present invention is its adaptability to existing textile equipment, such as the machines illustrated in FIGS. 1 and 2, by simply controlling the degree of feed of individual feed units within the already existing equipment, and the fact that complex fluid jet equipment and control therefor is unnecessary.

While I have shown and described several embodiments of the invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

I claim:

1. A process for producing bundle yarn having neutral torque from a plurality of groups of textured filaments comprising the steps of:

supplying a prescribed degree of positive tension to respective plural separated groups of textured filaments by passing the separated groups of textured filaments from a first yarn feed roller means to a second yarn feed roller means, at least two of said groups having been imparted with opposing torques;

bringing the tensioned plural separated groups of textured filaments together; and causing the tensioned groups of textured filaments to relax between said second yarn feed roller means and a yarn take-up means, whereby the oppositely-torqued groups of textured filaments are caused to tangle themselves together to form bundle yarn having a resultant neutral torque.

2. A process according to claim 1, wherein said groups of textured filaments are formed by individually false-twisting continuously supplied groups of textile filaments.

3. The process according to claim 2, wherein said groups of textured filaments include a yarn of "s" twisted filaments and a yarn of "z" twisted filaments.

4. The process according to claim 1, wherein said tension supplying step comprises passing said group of textured filaments over a yarn feed roller of said first yarn feed roller means and causing said roller to underfeed said groups of filaments thereover.

5. The process according to claim 1, wherein said relaxing step comprises passing said groups of tension textured filaments over a yarn feed roller of said second yarn feed roller means and causing said roller to overfeed said filaments thereover.

6. The process according to claim 1, wherein said tension supplying step comprises the steps of passing said groups of textured filaments over said first yarn feed roller means and causing said first roller means to underfeed said groups of filaments thereover, and said relaxing step comprising the steps of passing the underfed, tensioned textured groups of filaments over the second yarn feed roller means and causing said second roller means to overfeed said groups of filaments thereover.

7. The process according to claim 6, wherein said groups of textured filaments are formed by individually false-twisting continuously supplied groups of textile filaments.

8. The process according to claim 7, wherein said groups of textured filaments include a yarn of "s" twisted filaments and a yarn of "z" twisted filaments.

9. A process for producing bundle yarn having neutral torque from two multi-filament yarns comprising the steps of:

separately false-twisting two yarns to provide opposing torques to each yarn;

applying positive tension separately to each of said oppositely-torqued yarns between a first yarn feed roller means and a second yarn feed roller means;

bringing the tensioned separated two yarns together on said second yarn feed roller means; and causing the tensioned two yarns of opposing torque to relax between said second yarn feed roller means and another roller means whereby the oppositely-torqued yarns are caused to tangle themselves together to form bundle yarn having a resultant neutral torque.

10. The process according to claim 9, wherein one of said two yarns has "s" twisted filaments and the other of said two yarns has "z" twisted filaments.

11. An apparatus for bundling yarn from a plurality of continuously moving groups of textured filaments comprising:

first roller means for receiving plural separated groups of textured filaments, at least two individual groups of which have been imparted with opposing torques and for underfeeding said groups of said filaments to a second roller means whereby a prescribed degree of positive tension is imparted to said groups of said filaments;

a third roller means for receiving the groups of filaments from said second roller means, said second roller means causing the groups of tensioned filaments to come together and overfeeding said groups of filaments with respect to said third roller means whereby said groups of filaments are caused to relax between said second roller means and said third roller means and whereby the relaxed groups of oppositely-torqued filaments entangle with each other to form a bundled yarn.

12. An apparatus according to claim 11, further comprising means for false-twisting each respective group of filaments to impose opposing torques to said respective groups of filaments.

13. An apparatus according to claim 11, wherein said third roller means comprises means for forming a yarn package of said bundled yarn.

* * * * *